US006152344A

United States Patent [19]

Jensen

[11] Patent Number: 6,152,344

[45] Date of Patent: Nov. 28, 2000

[54] DISPENSER FEEDER PROVIDING EXTENDED MATERIAL END

[76] Inventor: Lars D. Jensen, 6604 Cliffwood Ct., Arlington, Tex. 76016

[21] Appl. No.: 09/207,533

[22] Filed: Dec. 8, 1998

[51] Int. Cl.[7] ..... B26F 3/02

[52] U.S. Cl. ..... 225/12; 225/23; 225/77; 225/96.5

[58] Field of Search ..... 225/12, 23, 77, 225/96.5

[56] References Cited

U.S. PATENT DOCUMENTS

| | | | |
|---|---|---|---|
| 1,094,765 | 4/1914 | Weeks . | |
| 1,261,668 | 4/1918 | Winterhalter . | |
| 1,299,087 | 4/1919 | Winterhalter . | |
| 2,274,623 | 2/1942 | Hawkins . | |
| 2,434,776 | 1/1948 | Van Cleef et al. . | |
| 2,484,673 | 10/1949 | Becker . | |
| 2,506,504 | 5/1950 | Hudson . | |
| 2,522,047 | 9/1950 | Krueger et al. . | |
| 2,555,187 | 5/1951 | Erhardt . | |
| 2,573,912 | 11/1951 | Krueger . | |
| 2,574,175 | 11/1951 | Erhardt . | |
| 2,582,705 | 1/1952 | Krueger . | |
| 2,590,549 | 3/1952 | Krueger . | |
| 2,599,750 | 6/1952 | Erhardt . | |
| 2,621,737 | 12/1952 | Ledig | 225/12 |
| 2,663,369 | 12/1953 | Erhardt . | |
| 3,273,772 | 9/1966 | Nakajima et al. . | |
| 3,521,800 | 7/1970 | Stephens et al. . | |
| 3,628,710 | 12/1971 | Mannheim | 225/12 |
| 4,262,835 | 4/1981 | Wrobel . | |
| 4,493,446 | 1/1985 | Wirth . | |
| 4,586,639 | 5/1986 | Ruff et al. . | |
| 4,608,894 | 9/1986 | Lee et al. . | |
| 4,780,172 | 10/1988 | Shea . | |
| 4,787,542 | 11/1988 | Ruff et al. . | |
| 4,787,543 | 11/1988 | Fabo et al. . | |
| 4,793,536 | 12/1988 | Urushizaki . | |
| 4,856,397 | 8/1989 | Rebekale . | |
| 5,381,942 | 1/1995 | Lin | 225/77 |

*Primary Examiner*—M. Rachuba
*Attorney, Agent, or Firm*—Lars D. Jensen

[57] ABSTRACT

A manual dispenser of material of indeterminate length, which is yieldably retained on a movable feeder, such that when the end of the material is pulled, the feeder moves until it reaches a stop, whereupon additional material is yielded from the feeder to a length suitable to the user. The material is then forced to sever against a cutter, creating a useful material segment, and also releasing the feeder to return to its initial position, powered by a biasing spring. Upon return, the feeder holds the remnant end of the material extended, readily accessible for grasping. An alternate embodiment comprises a movable cutter.

30 Claims, 12 Drawing Sheets

DISPENSER FEEDER PROVIDING EXTENDED MATERIAL END

CROSS REFERENCE

This application is also related to application Ser. No. 09/206,324 filed on even date herewith, entitled "Dispenser Roller Providing Extended Material End," by inventor Lars D. Jensen. Which application is not admitted to be prior art by its mention as this reference.

BACKGROUND

Materials of indeterminate length fall into two general categories: a) web-like shapes, such as paper, aluminum foil, and tape; and b) filament-like shapes, such as string, wire, and tubing. Web dispensers must be designed to overcome common problems such as handling and cutting across wide material. Filament dispensers may have common problems such as controlling twisting and backlash. However, every dispenser (regardless of type of material) must provide some kind of feeding action. The feeding action is that way of advancing new material and controlling the cut end (which remains after the previously dispensed segment has been removed.) The cut end must be "retained" so as not to become loose or hard to find. It is also preferable that the cut end be at a "convenient position," having moved away from the cutter (or whose cutter has been moved away.) Finally, an ideal feeder would provide an extended end of material, ready to simply grasp and pull.

Using a common dispenser of prior art, where a material is cut manually by forcing it against a sharp edge, the user leaves with the segment. The user has no further involvement with the dispenser, so the cut end typically stays near the cutter.

Some inventions of prior art have included additional mechanisms to advance the material. Sometimes, this is done by pushing a button or pulling a lever. This is not desirable, since it requires an extra step, making an extra effort. Other prior art dispensers advance the material automatically, using a motor or air cylinder. Some dispensers also cut automatically. While convenient, these automatic dispensers are complicated and not as affordable as manual dispensers.

In a few prior art dispenser designs, the user first pulls the desired length of material, and then uses the lateral cutting movement to activate some mechanism. However, none of these has been entirely satisfactory, the proof of which is that they have not become popularly used. Accordingly, there is a need for an inexpensive manually powered dispenser that provides an extended material end for easy grasping.

SUMMARY OF THE INVENTION

It is an object of the present invention to provide a dispenser which presents to the user an extended material end (which is the remnant from a previously dispensed segment.) This objective is achieved by the present invention in two ways. First, by having a movable feeder which moves after the cut is made, leaving the extended material end exposed. Secondly, by having a feeder and cutter, both of which move after the cut, to positions which make the extended material end readily accessible.

A second object of the present invention is to provide a dispenser which is manually-powered. This objective is achieved by storing energy from the act of advancing the feeder and material, and by using the act of cutting to release that energy to return the feeder.

A third objective of the present invention is to provide a dispenser which is affordable for typical home and office use. This objective is achieved by a simple design, having few moving parts, most of which can be fabricated inexpensively using the plastic injection molding process.

The following illustrations and descriptions will disclose an entirely new dispensing action. Dispensers of prior art have actions where the user first pulls the material longitudinally to a desired length. Secondly, the user moves the material laterally (on the way to the cutter) against some "push away" or "triggering" device. By contrast, the present invention acts to first move and store energy in a feeder during the initial longitudinal movement. Then, the feeder yields additional material to a desired length. After cutting, the feeder reverses to provide an easily accessible extended material end. These and other features, aspects, and advantages will become better understood with regard to the following drawings, description, and appended claims.

REFERENCE NUMERALS USED IN THE DRAWINGS

Figure 1:
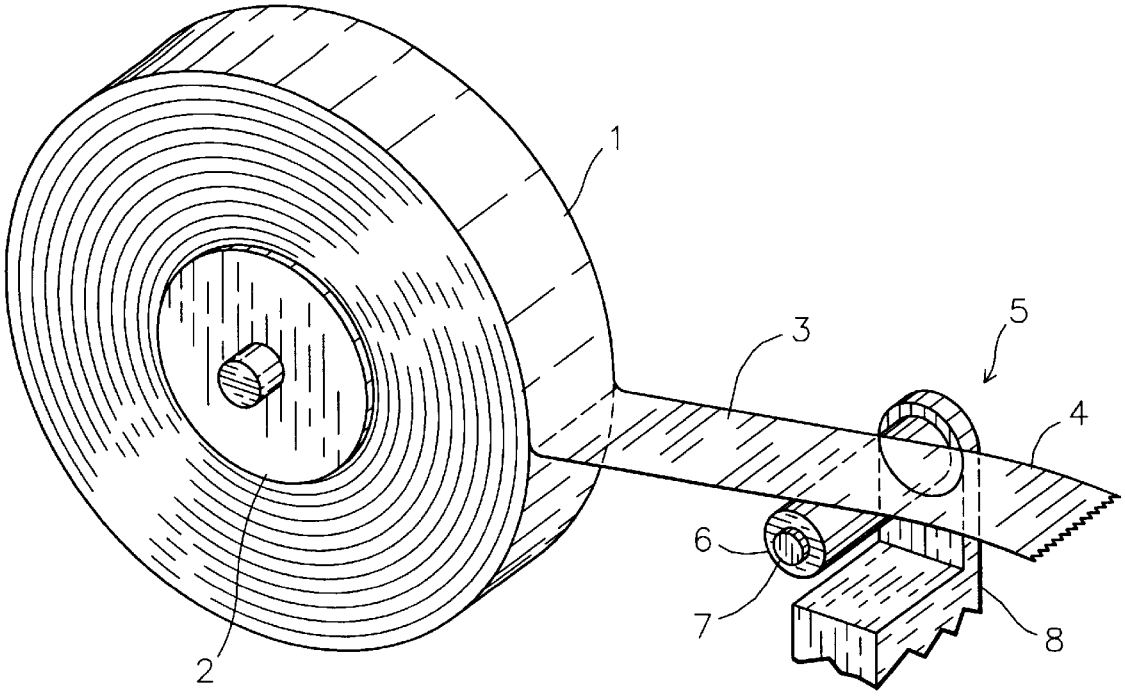
FIG. 1 is a perspective view of feeder A.

1 roll of tape 27 smaller shaft
2 core roller 28 large roller
3 drawn piece of tape 29 shaft
4 extended tape end 30 extended tape end
5 feeder A 31 small roller
6 roller 32 shaft
7 shaft 33 extended tape end
8 feeder support 34 feeder C
9 high alternate tape position 35 belt
10 low alternate tape position 36 shoe
11 feeder B 37 feeder support
12 large roller 38 keeper
13 large shaft 39 feeder D
14 small roller 40 supply of material
15 small shaft 41 drawn piece of material
16 feeder support 42 extended material end
17 internal side wall 43 feeder support
18 keeper 44 mouth
19 toothed roller 45 pinch slot
20 tooth 46 material
21 slotted roller 47*a* first surface
22 disk 47*b* second surface
23 slot 48 material
24 nominal roller 49*a* first surface
25 nominal shaft 49*b* second surface
26 larger roller 49*c* third surface
50 cambered roller 255' new extended tape end
51 cambered surface 256 segment of tape
52 extended tape end 257 cutter
100 feeder 258 screw
100*a* alternate feeder 259 side guard
101 feeder support 260 initial pull direction
101*a* alternate feeder support 261 continued pull direction
102 stub wing 262 cutting direction
103 slot 263 cut edge
104 spring mount 264 sharp edge
105 spring anchor 300 feeder
106 spring 301 feeder support
107 cut out edge 302 pivot pin
108 rivet 303 link
109 pinch spring 304 link pin
110 shoe 305 cutter
111 roller 306 cutter arm
112 shaft 307 cutter pivot pin
150 base 308 spring mount
151 supply of material 309 spring anchor
152 drawn piece of material 310 spring
153 slack shape 311 stop edge
154 straight shape 312 foot
155 extended material end 313 stop ledge
155' new extended material end 350 base
156 segment of material 351 roll of tape
157 cutter 352 drawn piece of tape
158 screw 353 slack shape
159 side guard 354 straight shape
160 initial pull direction 355 extended tape end
161 continued pull direction 355' new extended tape end
162 cutting direction 356 segment of tape
163 cut edge 357 cutter blade
164 sharp edge 358 screw
200 feeder 359 side guard
201 feeder support 360 initial pull direction
202 pivot pin 361 continued pull direction
203 weight 362 cutting direction
204 stop surface 363 cut edge
205 stop 364 sharp edge
250 base 400 feeder
251 roll of tape 401 feeder support
252 drawn piece of tape 402 pivot pin
253 slack shape 403 link
254 straight shape 404 weight
255 extended tape end 405 link pin
406 cutter 454 straight shape
407 cutter arm 455 extended tape end
408 cutter pivot pin 455' new extended tape end
409 upper cover 456 segment of tape
410 foot 457 cutter blade
411 left shaft 458 stop ledge
412 left roller 459 side guard
413 right shaft 460 initial pull direction
414 right roller 461 continued pull direction
415 aperture edge 462 cutting direction
450 base 463 cut edge
451 roll of tape 464 sharp edge
452 drawn piece of tape
453 slack shape

DETAILED DESCRIPTION OF THE INVENTION

An essential component of the present invention is the unique feeder. Therefore, it is instructive to first describe the feeder and define the terms of its operation in detail. A feeder is presently defined as: "A device which provides a path for material of indeterminate length, where the material is yieldably retained."

The material must be "retained" by the feeder so that the end of the material does not become lost and can be extended for easy grasping. Generally, a material must be guided on at least two opposite sides of the material. In the case of adhesive tape, being continuously adhered on one side is sufficient to be considered "retained."

The material must be retained "yieldably" for the proper operation of the present invention. When the material is pulled, it must not move through the feeder until the pulling force equal or exceeds a certain drag force (at which the feeder yields an additional length of material). On the contrary, an initial pulling force should cause the feeder to move instead of "the material moving through it." Therefore, the feeder comprises a means of yieldably retaining the material, where if a pulling force which is less than the drag force is exerted on an extended material end, then the material will not move relative to the feeder, and if a pulling force which is equal to or greater than the drag force is exerted, then the material moves relative to the feeder. Also, the present invention comprises a bias force which returns the feeder to its initial position.

The term "yieldable" may be subjective. Therefore it is defined, in regard to the present invention, as: "Not allowing movement of the material through the feeder in spite of being pulled, until and unless the pull force equals or exceeds a certain drag force, where the drag force is greater than the bias force."

Now defining "yieldably retained" more particularly over prior art, the present invention requires that all features (comprising the means of yieldably retaining) must move with the feeder. By contrast, many inventions of prior art teach retaining the material by trapping it between one feature of a moving feeder and some other stationary feature. Such a feeder under the definitions of the present invention cannot be said to yieldably retain the material, since the stationary feature does not move with the feeder.

Figure 10A:
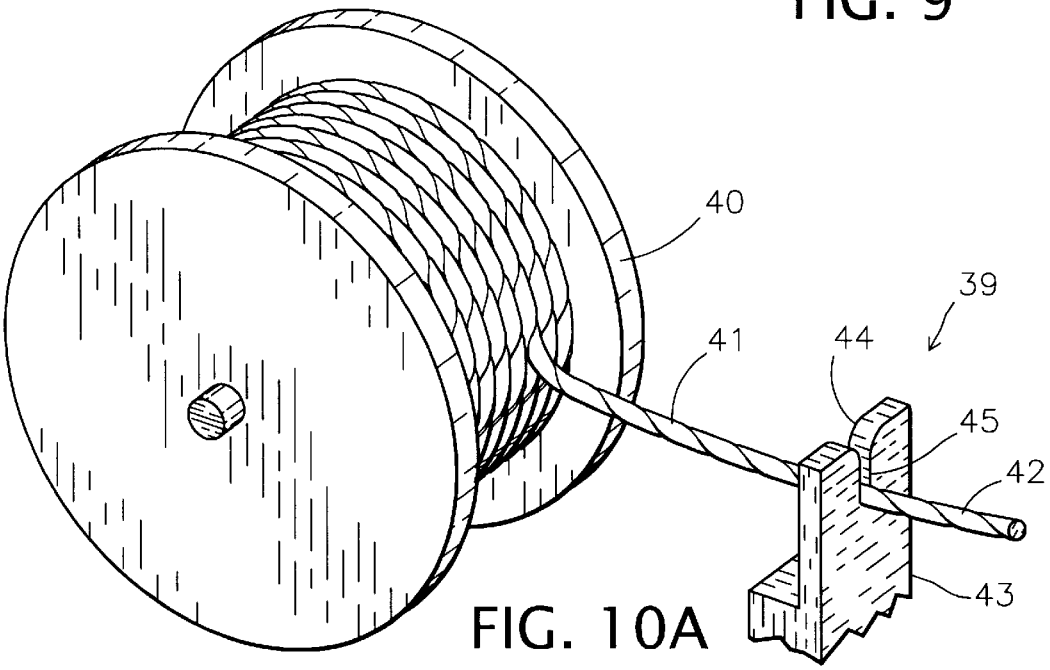
FIG. 10A is a perspective view of feeder D.
Figure 11A:
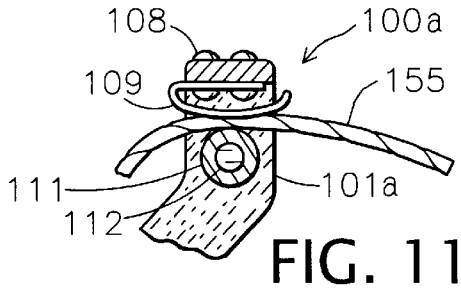
FIG. 11A is a partial side elevation of an alternate feeder construction
Figure 11:
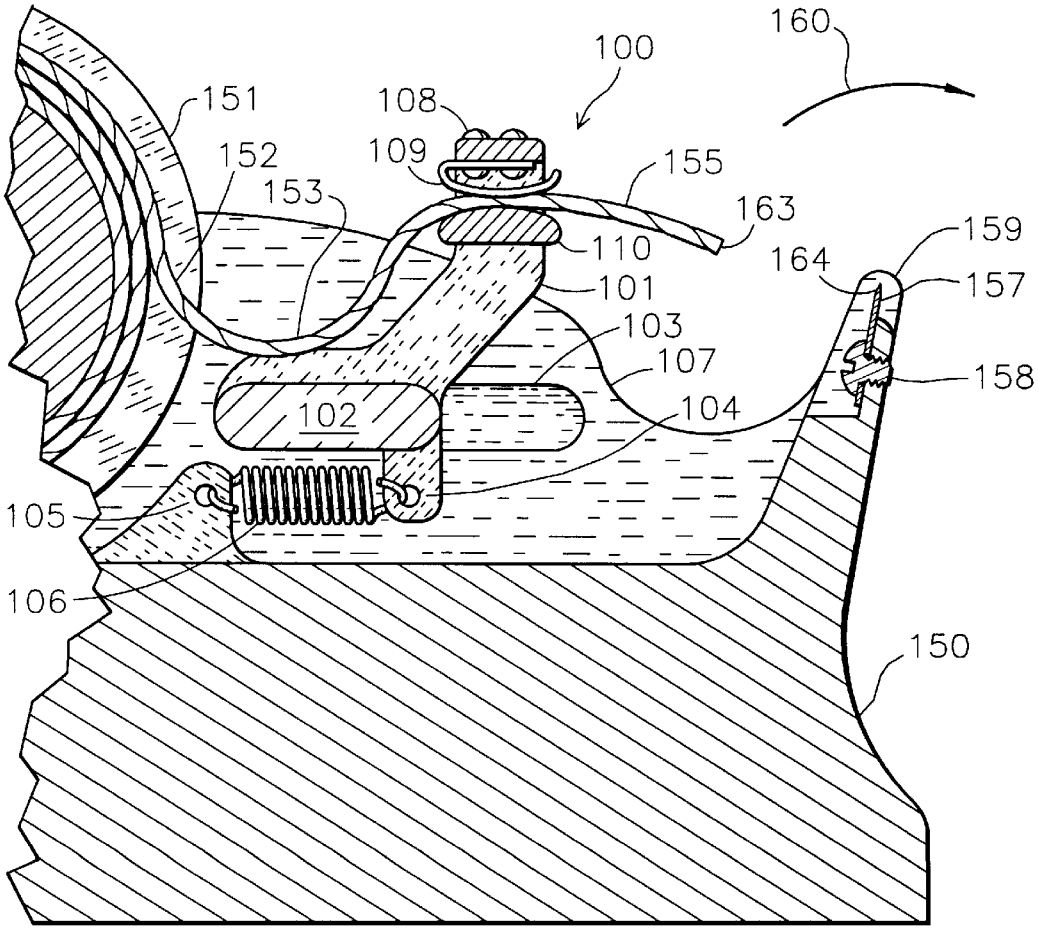
FIG. 11 is a side cross-sectional view of the first embodiment of the present invention in the initial position, ready to dispense a new segment of material.

Examples of feeders of material of indeterminate length which meet the above definitions are shown as "feeder D" 39 in FIG. 10A, feeder 100 in FIG. 11, and alternate feeder 100*a* in FIG. 11A.

Feeders of adhesive tape comprise a feature on which the tape is continuously adhered, but which permits the tape to move longitudinally. An example of such a feature is the roller 6 in FIG. 1 (but there are other devices which could be used, such as the belt 36 of FIG. 9.) There is a steady drag force, normally created by the adhesion of the tape to the roller plus the rolling friction of the roller. As the tape is fed on-to and off-of the roller, it must continuously "unpeel" from the roller which also creates drag.

In contrast to the present invention, an example of a feeder construction which does not "yieldably retain" adhesive tape would be a planar surface on which the tape is adhered. Unsticking and lifting the tape no longer retains it and no longer provides the necessary drag force. Or, if one tried to pull and move the stuck tape longitudinally, it would require a force so great as to be destructive to the tape itself. Some prior art dispensers utilize "edge keeper tabs" which are small planar surfaces which reach around to be adhered in small areas to the sticky side of the tape. Edge keeper tabs (being small versions of the planar surfaces as described above) would not "yieldably retain" adhesive tape. Tape unsticks from these tabs (there being some doubt how well stuck initially) in an unpredictable way, causing a halting action which is unsuitable for the operation of the present invention.

Now drawing further distinctions about the present invention, "feeder A" 5 shown in FIG. 1 meets the present definition of yieldably retaining a tape only if that tape has adhesive on the underside. By contrast, a tape with adhesive only on the top side (or other web-like material having no adhesive) would not be considered yieldably retained by feeder A. Even if the tape or material were to be pulled downward against the roller, that feeder could not itself be said to "retain" the material, since the pull-down force would have been provided from elsewhere, and if it were to be removed, the material would clearly become free.

Figure 2:
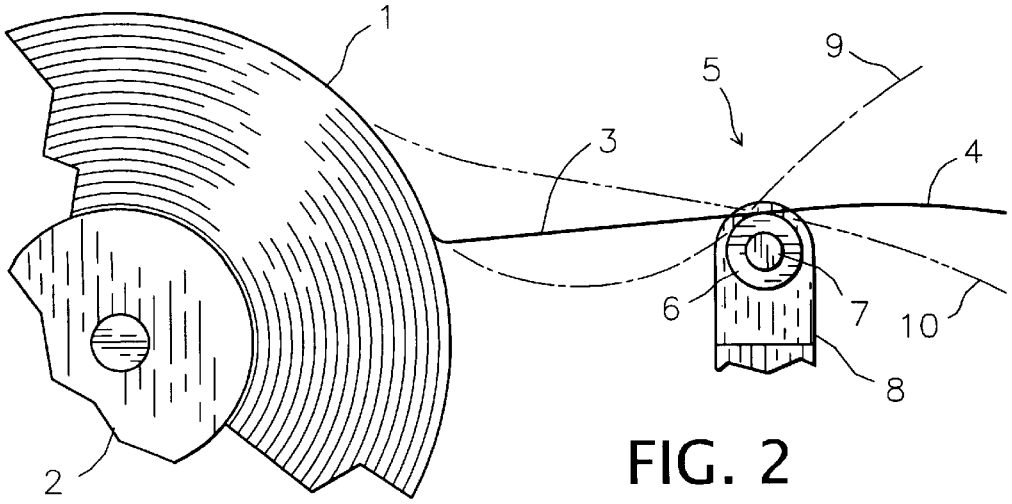
FIG. 2 is a side elevational view of feeder A.

As shown in its most basic form in FIG. 1, "feeder A" 5 comprises a roller 6 turning on a shaft 7 mounted on a feeder support 8. A conventional core roller 2 which is a means of rotatably supporting a conventional roll of tape 1 from which there is a drawn piece of tape 3 with the sticky side down. One can stick the middle of the tape to the roller thus disposing an extended tape end 4 in a cantilever manner. If one pulls on the extended tape end, then the drag of the roller would cause feeder A to move if it were free to do so. Then, if feeder A were restrained, additional pulling on the extended tape end would yield an additional length of tape (even while it remained continuously stuck to the roller.) Now "feeder A" 5 permits some variation in the angle of the tape as shown in FIG. 2 as high alternate tape position 9 and low alternate tape position 10 of the extended tape end 4 owing to the free rotary action of roller 6. Also, the tape may become unstuck if the user lifts too much while pulling the tape.

Figure 3:
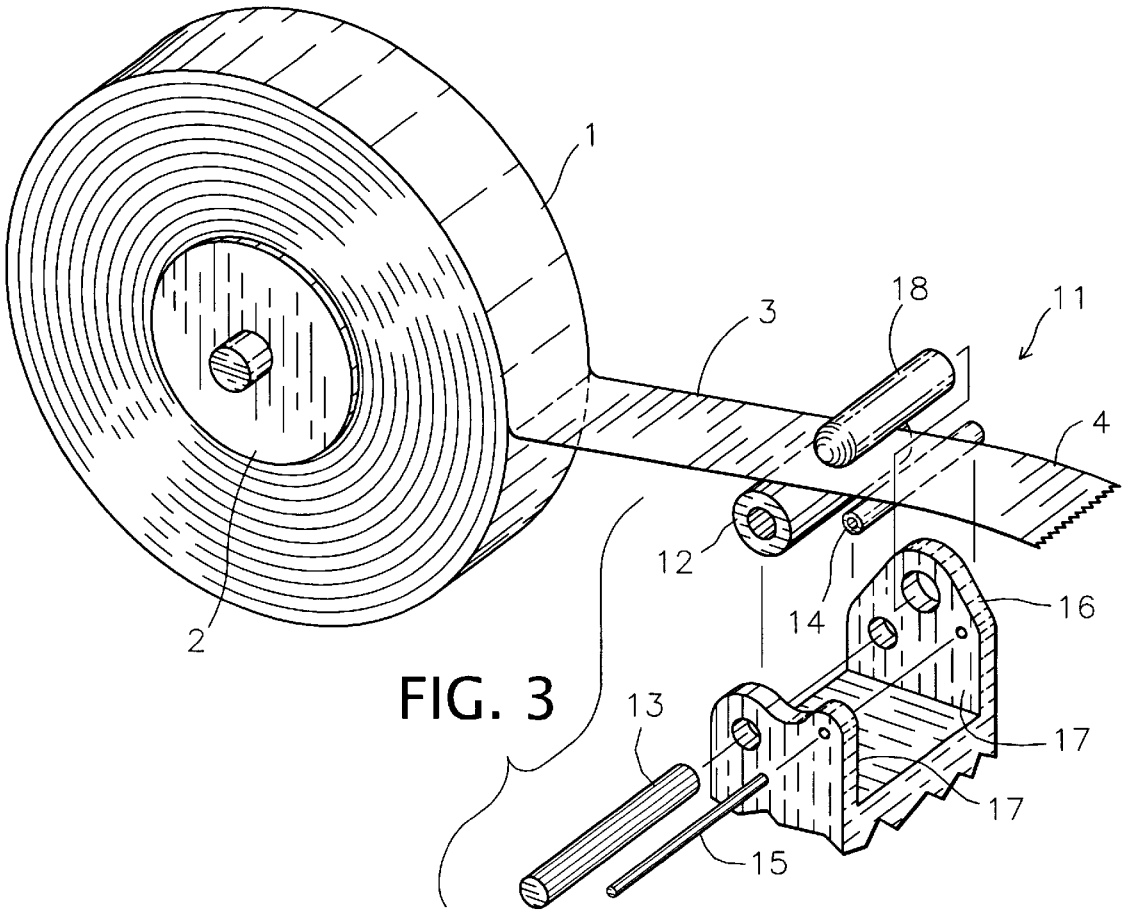
FIG. 3 is an exploded perspective view of feeder B.
Figure 4:
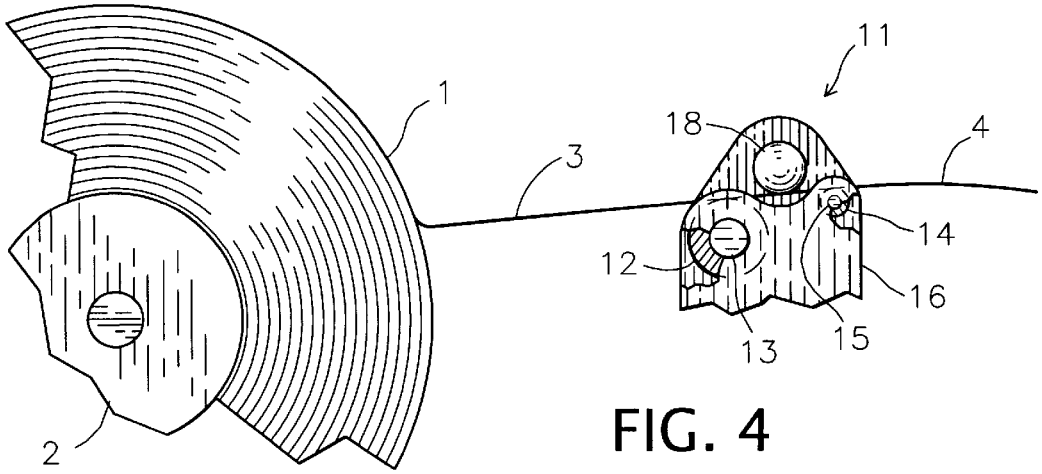
FIG. 4 is a side elevational view of feeder B.

Therefore, the preferred design of a feeder of adhesive tape is shown in FIGS. 3 and 4 as "feeder B" 11 where there is a large roller 12 which turns on large shaft 13 and a small roller 14 which turns on small shaft 15. The ends of the large shaft and the small shaft are held with a friction fit in corresponding holes in feeder support 16. The lateral movement of the tape is limited by an internal side wall 17 on each side.

An alternate method of constructing these rollers (which is not illustrated) is to make each roller of solid construction with contiguous male axle tip features at each end. The axle tip features could then be rotatably fitted into corresponding hole features in the feeder support. An advantage to this construction is that the axles would be eliminated.

FIGS. 3 and 4 also show a keeper 18 over the tape which is a cantilever round rod. It is fixed with friction fit in a corresponding hole in the feeder support 16. The keeper need not turn, because the smooth side of the tape slides under the keeper easily. However, if double-sided tape (which is sticky on both sides) is to be dispensed, then the keeper could also be constructed as a roller. The keeper is open at one end, so the user can conveniently install the tape by wrapping it around the keeper (and away from sticking to the rollers) while sliding it in from one side. The purpose of the keeper is to prevent the tape from becoming unstuck from the rollers in the event that the user inadvertently lifts the tape while pulling. "Feeder B" 11 will work, however, without a keeper for tapes with adhesive on the underside.

FIGS. 3 and 4 further show how the tape passes over and adheres to rollers 12 and 14 establishing a dependable position for the extended tape end 4, whose direction is defined by a tangent to both rollers. The feeder disposes the extended tape end in a cantilever manner. If one were to pull on the extended tape end, then the drag force of the rollers would cause "feeder B" 11 to move (but without the rollers turning) if it were free to do so. Then, if feeder B were restrained, additional pulling on the extended tape end would yield an additional length of tape (even while it remained continuously stuck to the rotating rollers.)

Figure 5:
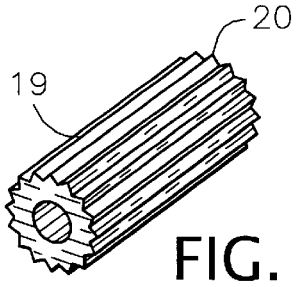
FIG. 5 is a perspective view of an alternate feeder roller with teeth.

A drag force is created when the tape is pulled enough to make it move. This force is the sum of two forces, namely the unpeeling force (of the rollers, not the tape roll) and roller friction force. The unpeeling force can be controlled by varying the surface texture or by altering the shape of a roller. FIG. 5 shows a toothed roller 19 which has multiple sharp-tipped teeth around its circumference, one of which is shown as tooth 20. The toothed roller has less unpeeling force than one which has a smooth cylindrical shape.

Figure 6:
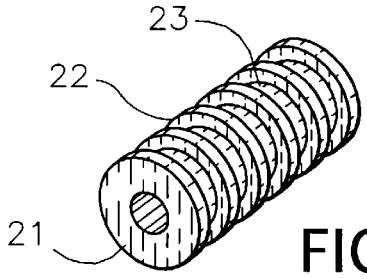
FIG. 6 is a perspective view of an alternate feeder roller which is slotted.

FIG. 6 shows a slotted roller 21 which has multiple disk 22 elements separated by slot 23 features. Likewise, the slotted roller has less unpeeling force than one which has a smooth cylindrical shape.

Figure 7A:
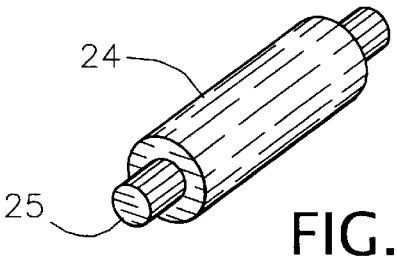
FIG. 7A is a perspective view of a nominal feeder roller.
Figure 7B:
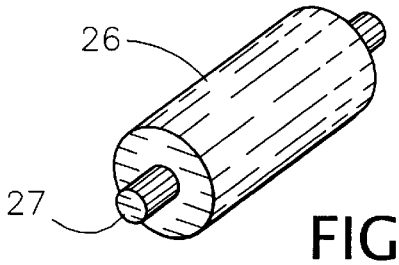
FIG. 7B is a perspective view of a feeder roller with reduced rolling friction.

The roller friction force can be controlled in a number of ways. FIG. 7A shows a nominal roller 24 mounted on a nominal shaft 25. By comparison, FIG. 7B shows a larger roller 26 and a smaller shaft 27. Both or either of these diameter changes will result in a roller having less friction force than that shown in FIG. 7A. Of course, there are other ways of controlling friction force, such as fitting the rollers with ball bearings, lubricating, using low friction coefficient materials, etc.

Thus FIGS. 5, 6, 7A, and 7B have shown ways of controlling the drag force. As was stated earlier, a certain amount of drag force is required. Therefore, one may use these methods of construction to increase the drag force as well as to reduce it.

Figure 8A:
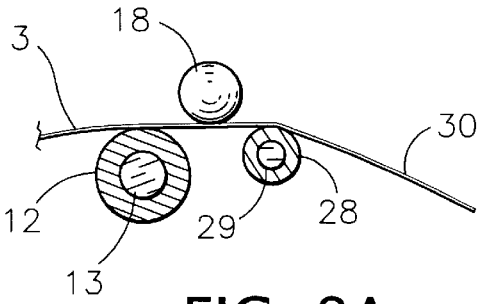
FIG. 8A is a side elevational view of a feeder with a larger front roller.
Figure 8B:
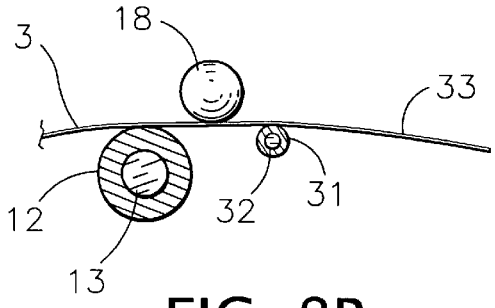
FIG. 8B is a side elevational view of a feeder with a smaller front roller.

A roller of small diameter is preferred for supporting an adhesive extended tape end. FIG. 8A shows a feeder construction similar to that of FIG. 4 where there are identical elements having reference numerals 3, 12, 13, and 18, but with a large roller 28 which turns on shaft 29. The extended tape end 30 extends outwardly, but is deflected downward because of the sticky influence of large roller 28. By comparison, FIG. 8B shows a small roller 31 which turns on shaft 32. Notice how the extended tape end 33 extends out in a more horizontal direction, being influenced less by the small roller 31.

Figure 8C:
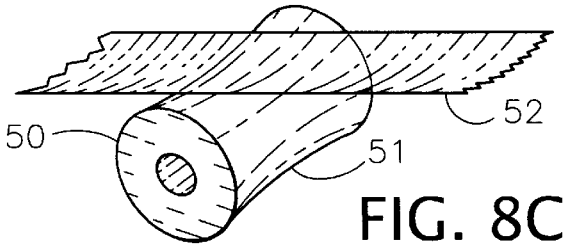
FIG. 8C is a perspective view of a cambered roller.

FIG. 8C shows a cambered roller 50 which can be used in a feeder for tape with the tacky side adhered to the cambered surface 51. An extended tape end 52 is shown extending from this roller with camber, and thus is supported in a straight shape.

Figure 9:
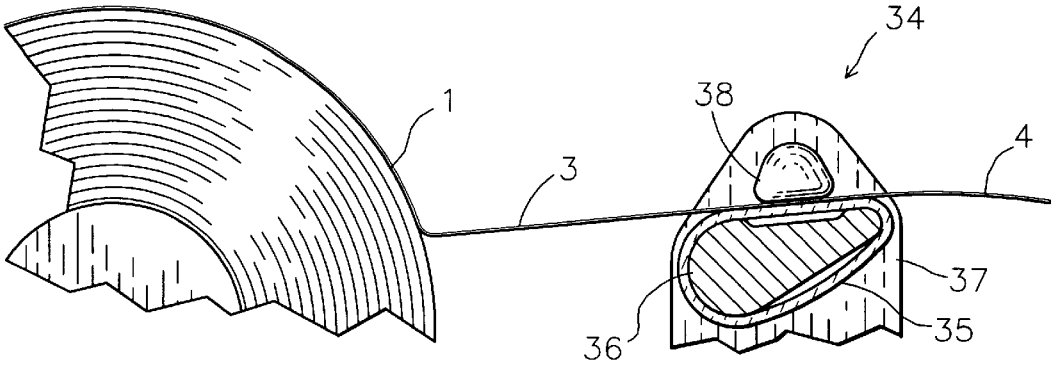
FIG. 9 is a side elevational view of feeder C.

FIG. 9 shows another design of a feeder given the notation "feeder C" 34, which has a flexible belt 35, which slides around a shoe 36, which supports and gives shape to the belt. There is a feeder support 37. There can be a keeper 38 above, although feeder C will also work without a keeper for tapes with adhesive on the underside. If one were to pull on the extended tape end 4, then the drag of the flexible belt would cause feeder C to move if it were free to do so. Then, if feeder C were restrained, additional pulling on the extended tape end would yield an additional length of tape (even while it remained continuously stuck to the flexible belt.)

FIG. 10A shows yet another design of a feeder given the notation "feeder D" 39. There is a supply of material 40, from which there is a drawn piece of material 41. A feeder support 43 has features of a mouth 44 and a pinch slot 45. There is an extended material end 42 which is disposed in a cantilever manner. The material shown has a pliable quality so that it may be forced into the mouth and down into the pinch slot (where it remains until the supply is exhausted.) The inside surfaces of the pinch slot are smooth and the width of the slot is only slightly less than the free thickness of the material. Therefore, the material is "yieldably retained" by feeder D, being guided on opposite sides, and held with a restriction which permits movement only when the pull force is sufficient. One skilled in the art may easily determine pinch slot dimensions which will provide the specified drag force. If one were to pull on the extended material end, then the drag of the pinch slot would cause feeder D to move if it were free to do so. Then, if feeder D were restrained, additional pulling on the extended material end would yield an additional length (even while it remained continuously restricted by the pinch slot.)

Figure 10B:
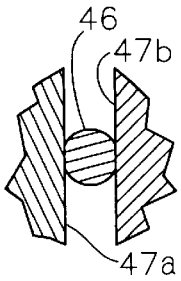
FIG. 10B is an end sectional view of a feeder with two surfaces located in opposition around the material.
Figure 10C:
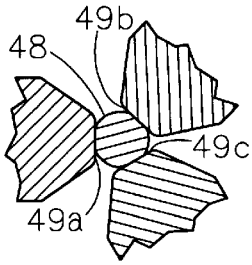
FIG. 10C is an end sectional view of a feeder with three surfaces located in opposition around the material.

A generalized construction of "feeder D" 39 is shown in FIG. 10 B where two surfaces, namely a first surface 47*a* and a second surface 47*b*, are located in opposition around a material 46, where the surfaces are in sliding frictional contact with the material. The drag force is the sum of every force of frictional contact when the material is pulled and moved. Both surfaces move in unison with the feeder when the feeder moves. While shown around a filament-type material, this construction works equally well around a web-like material An end view of another general construction of a feeder is shown in FIG. 10C where three surfaces, namely a first surface 49*a*, a second surface 49*b*, and a third surface 49*c* are located in opposition around a material 48, thus more specifically giving definition to the term "located in opposition around the material." The shape of the surfaces may be planar or non-planar and may also have a rough or smooth texture as a way of controlling the drag force. The surfaces are in sliding frictional contact with the material. The drag force is the sum of every force of frictional contact when the material is pulled and moved. All three surfaces move in unison with the feeder when the feeder moves. In like manner, a feeder may be constructed of four or more surfaces, leading ultimately to a fully-surrounding contiguous hole, which is slightly smaller than the diameter of the material, through which the material is fed.

The design of the feeder as shown in FIGS. 3 and 4 as "feeder B" 11 is preferred for dispensing a tape with adhesive on the lower surface and will be shown in the embodiments of the present invention that follow in FIGS. 13 through 18.

Thus, the terms "feeder" and "yieldably retained" have been defined for the present invention and several methods of constructing a feeder which yieldably retains a material have been demonstrated. These and other methods of construction are deemed to be within the scope of what will be later claimed of the present invention.

Figure 12:
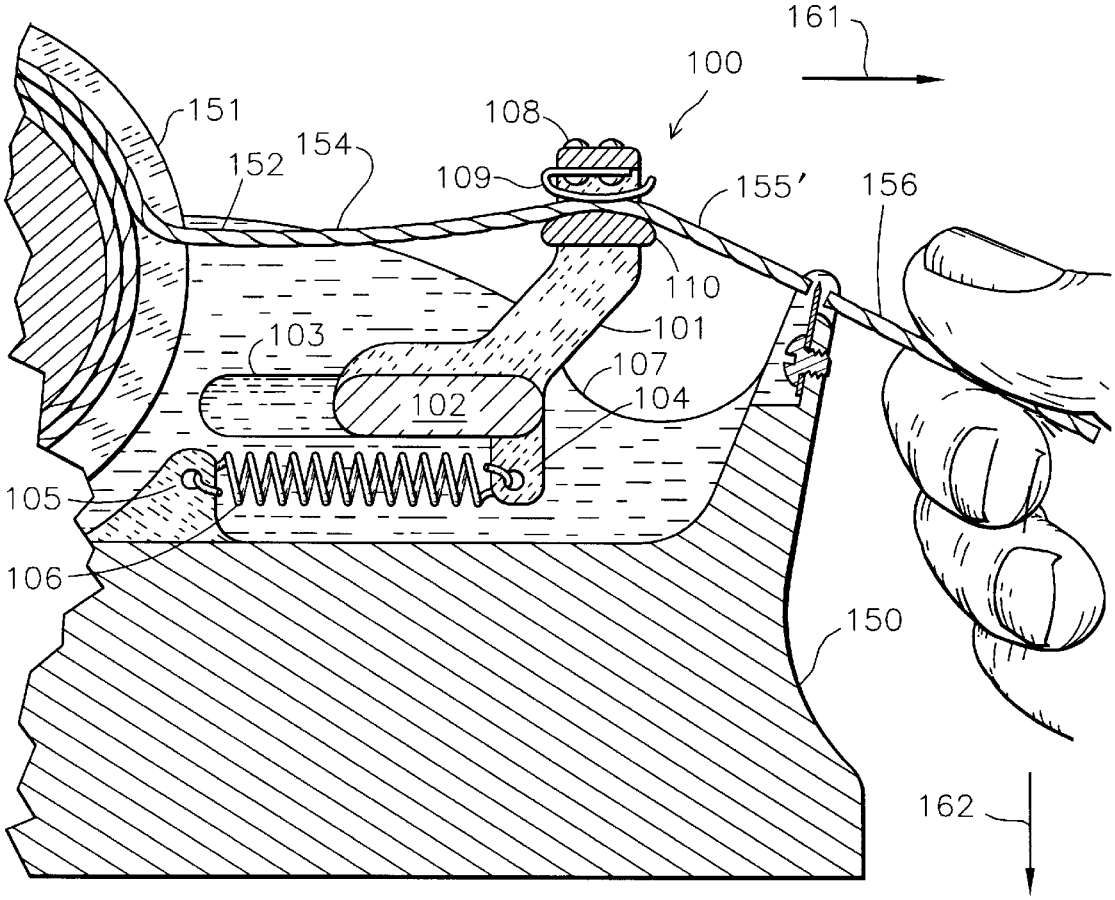
FIG. 12 is a side cross-sectional view of the first embodiment of the present invention at the moment when a new segment of material is cut.

Now, the first full embodiment of the present invention is shown in FIGS. 11, 11A, and 12. A dispenser base 150 is shown in cross-section and may be considered to have a full construction symmetrical about the cutting plane. Conventional elements include a supply of material 151, which is rotatably supported by means (not shown) of an axle end on each side of the supply roll fitting into a corresponding hole in each internal side of the base. There is a drawn piece of material 152. There is a cutter 157 having a sharp edge 164, which is fixed relative to the base by a screw 158. There is a side guard 159 adjacent to the blade on each end to protect the user from being accidentally cut.

There is a feeder 100 which is movably supported relative to the base. There is a feeder support 101 which supports a shoe 110 and a pinch spring 109 which is fastened to the feeder support above the material with two of a rivet 108. The pinch spring has been designed to create a certain drag force. While this feeder depicts a filament-shaped material, it could also be modified to accommodate a web-shaped material by making the shoe and the pinch spring wide. FIG. 11A shows an alternate feeder 100*a*, which has the same pinch spring forcing the material against a roller 111 which rotates on a shaft 112 which is mounted on an alternate feeder support 101*a*. The roller is in non-sliding frictional contact with the material, and the roller is rotatably supported by the alternate feeder. The roller turns with a frictional drag against the shaft which is one of several ways to provide a torque means for creating torque acting to resist the rotation of the roller. The torque of the roller may be controlled by methods which have been discussed, or by adding friction elements commonly used in the art to purposefully create rotary drag. In alternate feeder 100*a*, the drag force is the sum of lower force resulting from the torque and the upper force of frictional contact with the pinch spring. Both the pinch spring and the roller move in unison with the alternate feeder when it moves.

By these examples, it should be apparent that a feeder meeting the definition of the present invention may be constructed of many combinations of surfaces, which can be planar or non-planar and may also have a rough or smooth texture as a way of controlling the drag force. One or all of the surfaces can be comprised of rollers whose rolling friction can be controlled by design.

The feeder 100 can translate horizontally, guided by the sliding fit of a stub wing 102 (which is a feature on each side of the feeder support) in a slot 103 (which is a feature on each internal side of the base 150.)

Another feature of the feeder support 101 is a spring mount 104. A feature of the base 150 is a spring anchor 105. A spring 106 is connected at one end to the spring mount and at the other to the spring anchor. The spring is sized to provide a bias force which is slightly less than the drag force at all positions of the feeder.

The initial (at rest) position of the first embodiment of the present invention is shown in FIG. 11 where the feeder 100 is at an initial position (leftmost in this view) stopped by the stub wing 102 impinging on the left end of the slot 103, and where the feeder is being urged leftward by the bias force of the spring 106. There is a cutout edge 107 in each side of the base 150 which allows easy finger access to an extended material end 155. To begin the dispensing cycle, the user will grasp the extended material end and move in an initial pull direction shown by the arrow noted by reference numeral 160 in FIG. 11. Notice that there is a slack shape 153 in the material between the supply of material 151 and the feeder. This is a consequence of the final act of the dispensing cycle, which will be described later.

The drag force of the feeder 100 is greater than the spring bias force provided by the spring 106. Therefore, as the extended material end 155 is pulled, the feeder moves to the right until the stub wing 102 stops against the right end of the slot 103. Now the feeder is at the cutting position. The right end of the slot acts as a stop which is a means of preventing movement of the feeder beyond a cutting position in a direction away from the initial position. At that point, the user moves in a continued pull direction shown by an arrow noted by reference numeral 161 in FIG. 12 to further create a tension in the extended material end which keeps the feeder stopped. The drawn piece of material 152 is pulled into a straight shape 154 and then additional material is pulled from the supply of material 151 and is yielded through the feeder until a length of material as desired by the user is extended. Finally, the user manually forces the material in a cutting direction as shown by an arrow noted by reference numeral 162, until the material is severed against the sharp edge 164 (FIG. 11) of the cutter 157.

FIG. 12 shows the position where all of the components are located at that moment in time when a segment of material 156 is cut. This segment was previously the extended material end 155 (FIG. 11) plus additional length yielded by the user. After the cut, there is a new extended material end 155' (FIG. 12.)

Just before the position shown in FIG. 12, the continued pulling and tension in the material kept the feeder 100 stopped to the right. But, after the cut is made, the feeder is free to return to the initial position, and is pulled back to the left by the bias force of the spring 106. Then, after returning to the initial position, the present invention again looks as shown in FIG. 11. Notice that a surplus of the drawn piece of material 152 forms a slack shape 153 again, and that a cut edge 163 has moved away from the sharp edge 164.

Figure 13:
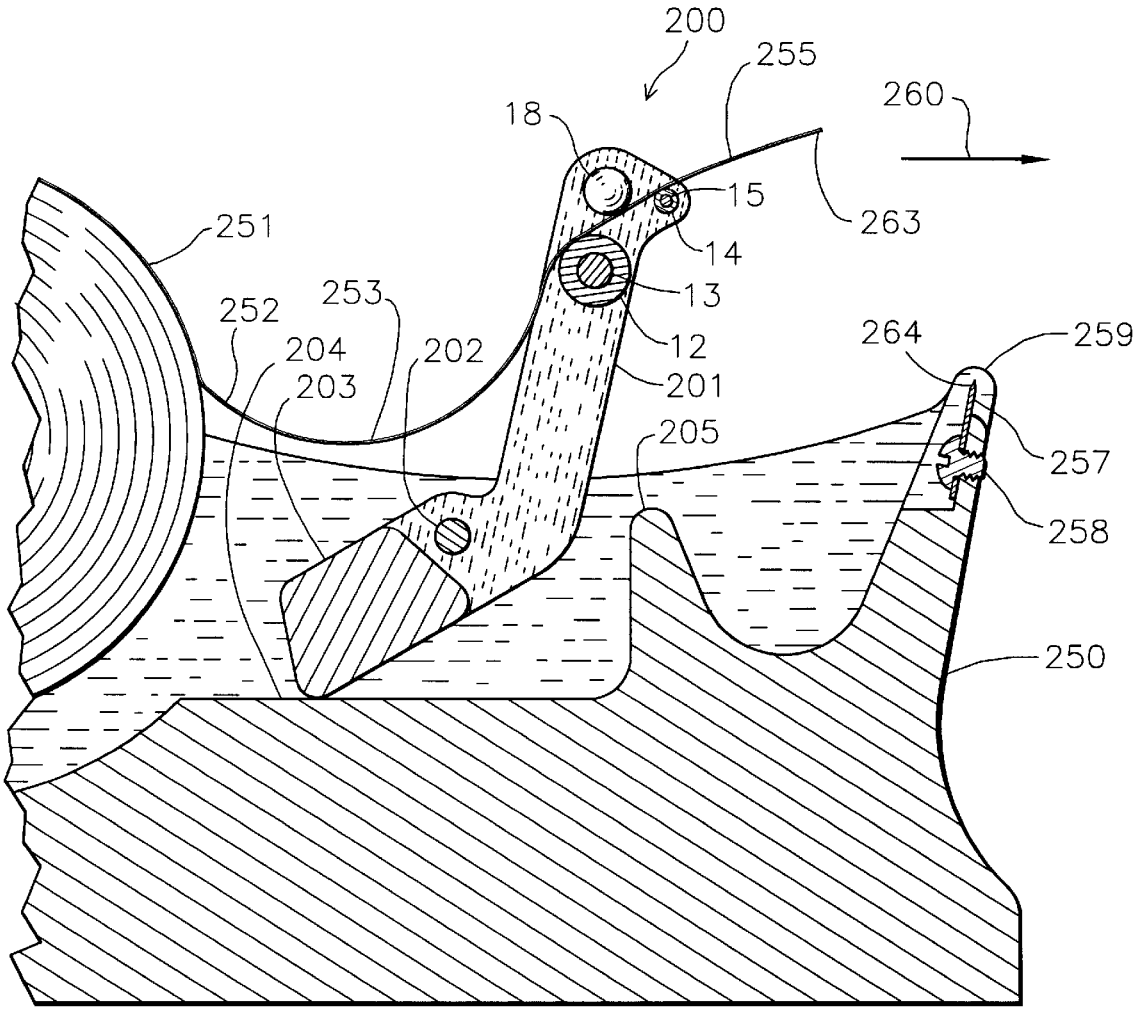
FIG. 13 is a side cross-sectional view of the second embodiment of the present invention in the initial position, ready to dispense a new segment of tape.
Figure 14:
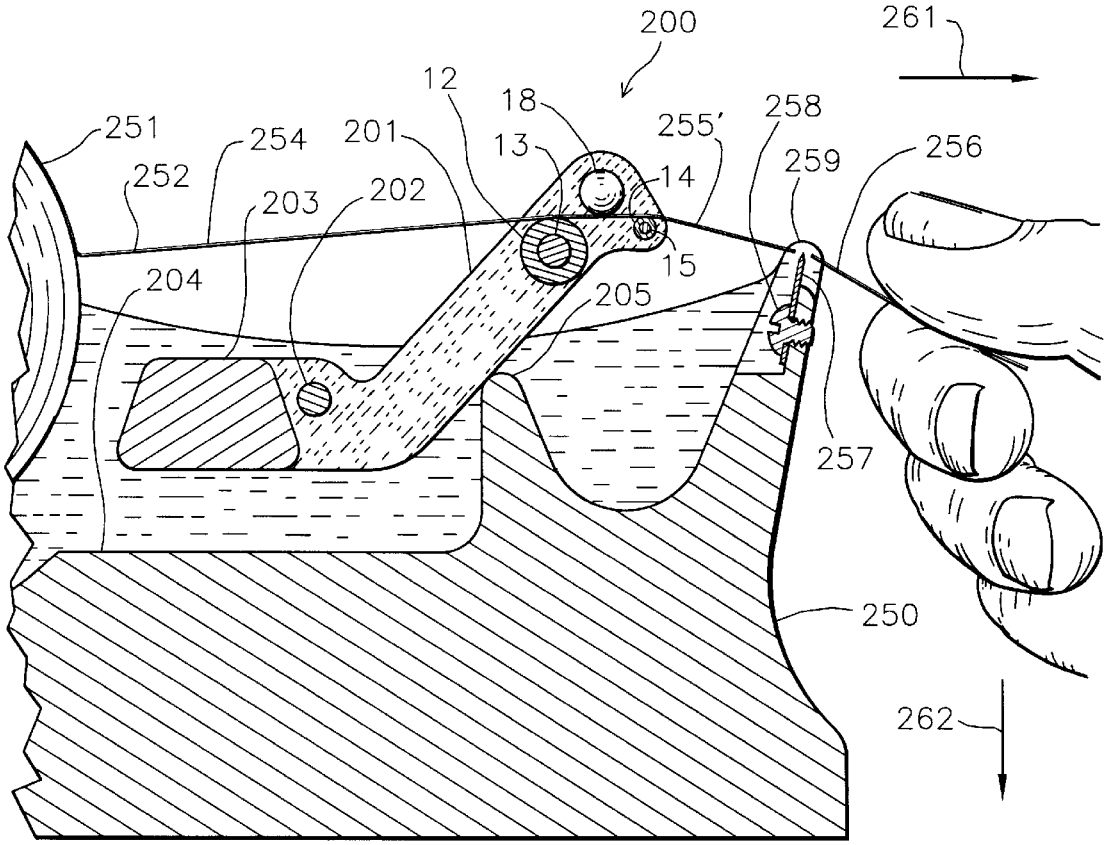
FIG. 14 is a side cross-sectional view of the second embodiment of the present invention at the moment when a new segment of tape is cut.

The second embodiment of the present invention is shown in FIGS. 13 and 14. A tape dispenser base 250 is shown in cross-section and may be considered to have a full construction symmetrical about the cutting plane. Conventional elements include a roll of tape 251, which is rotatably supported. There is a drawn piece of tape 252. There is cutter 257, having a sharp edge 264, which is fixed relative to the base by a screw 258. There is a side guard 259 adjacent to the blade on each end to protect the user from being accidentally cut.

There is a feeder 200 which is movably supported relative to the base. There is a feeder support 201 which supports components having reference numerals 12, 13, 14, 15 and 18 which are identical to those previously shown in FIG. 3. The feeder can rotate about a pivot pin 202 which is fitted into a corresponding opening in each of the internal sides of the base 250. Another feature of the feeder support is a weight 203. The weight acts to unbalance the total mass of the feeder to the degree that a certain bias force (pulling at the radius distance of the tape location) is required to rotate the arm clockwise. The value of this bias force changes as a function of angular position. Then, the weight is sized so as to create a bias force which is slightly less than the drag force at all angular positions of the feeder.

The initial (at rest) position of the second embodiment of the present invention is shown in FIG. 13 where the feeder 200 is at an initial position (most counterclockwise in this view) stopped by the weight 203 impinging on a stop surface 204, and where the feeder is being urged counterclockwise by the unbalanced force of the weight. Since the upper end of the feeder support 201 is above the cutter 257, there is easy finger access to an extended tape end 255. To begin the dispensing cycle, the user will grasp the extended tape end and move in an initial pull direction shown by the arrow noted by reference numeral 260 in FIG. 13. Notice that there is a slack shape 253 in the tape between the roll of tape 251 and the feeder. This is a consequence of the final act of the dispensing cycle, which will be described later.

It can now be realized that the novelty of the present invention is directed toward the feeder 200 having been purposefully designed to provide a drag force which is specified to be greater than the bias force provided by the weight 203. Therefore, as the extended tape end 155 is pulled, the first thing that happens is that the feeder moves, rotating clockwise until the feeder support 201 impinges against a stop 205. Now the feeder is at the cutting position. (This stop is a means of preventing movement of the feeder beyond the cutting position in a direction away from the initial position.) By way of comparison to prior art, notice that at this point, the feeder of the present invention has not allowed any material to yield. Now, the user moves in a continued pull direction shown by an arrow noted by reference numeral 261 in FIG. 14. The drawn piece of tape 252 is pulled into a straight shape 254, and then additional tape is peeled from the roll of tape 251 while it is yielded through the feeder, until a length of tape as desired by the user is advanced. Finally, the user manually forces the tape in a cutting direction as shown by an arrow noted by reference numeral 262, until the tape is severed against the sharp edge 264 (FIG. 13) of the cutter 257.

FIG. 14 shows the position where all of the components are located at that moment in time when a segment of tape 256 is cut. This segment was previously the extended tape end 255 (FIG. 13) plus additional length yielded by the user. After the cut, there is a new extended tape end 255' (FIG. 14.)

Just before the position shown in FIG. 14, the continued pulling and tension in the tape kept the feeder 200 stopped clockwise. But, after the cut is made, the feeder is free to return to the initial position, rotating counterclockwise by the unbalanced force of the weight 203. Then, after returning to the initial position, the present invention again looks as shown in FIG. 13. Notice that a surplus of the drawn piece of tape 252 forms a slack shape 253 again, and that a cut edge 263 has moved away from the sharp edge 264.

This embodiment contains some elements found in prior art. However, the user of prior art inventions first extends the material, then moves the feeder laterally (in the same step as cutting.) By contrast, the feeder of the present invention moves immediately upon pulling the material, and is fixed during the lateral cutting movement. The innovative element of the present invention that provides this action is the means of "yieldably retaining" with its specified drag force.

Figure 15:
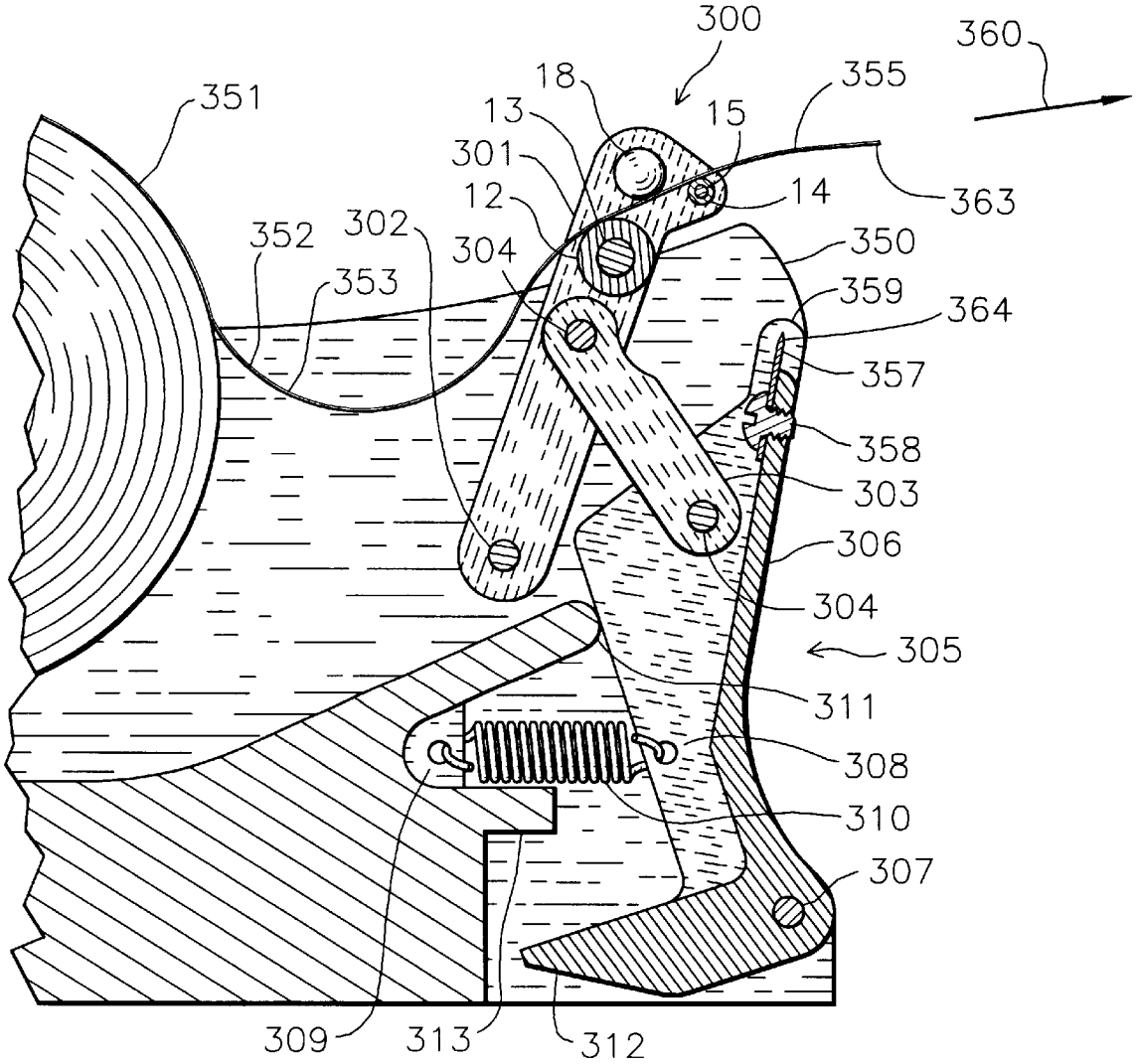
FIG. 15 is a side cross-sectional view of the third embodiment of the present invention in the initial position, ready to dispense a new segment of tape.
Figure 16:
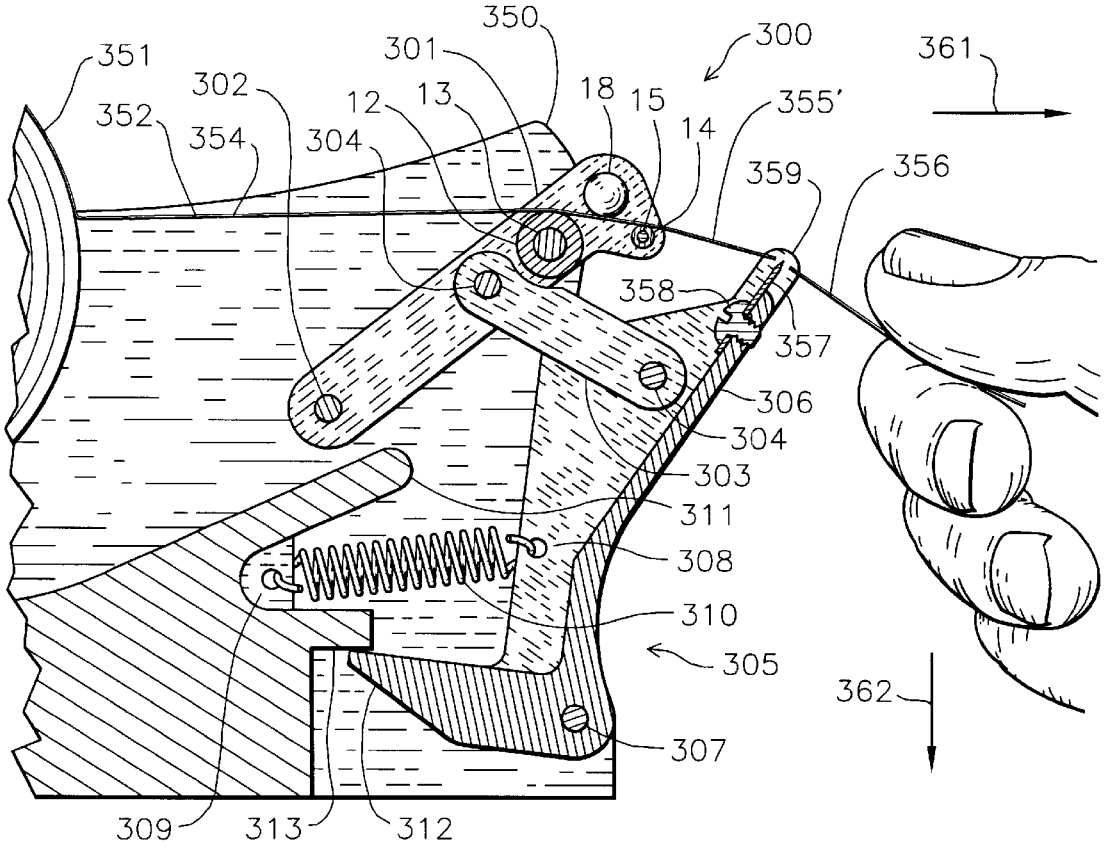
FIG. 16 is a side cross-sectional view of the third embodiment of the present invention at the moment when a new segment of tape is cut.

The third and preferred embodiment of the present invention is shown in FIGS. 15 and 16. A tape dispenser base 350 is shown in cross-section and may be considered to have a full construction symmetrical about the cutting plane. Conventional elements include a roll of tape 351, a drawn piece of tape 352, a cutter blade 357 having a sharp edge 364, which is held in place by a screw 358. There is a side guard 359 adjacent to the blade on each end to protect the user from being accidentally cut.

There is a feeder 300 which is movably supported relative to the base. There is a feeder support 301 which supports components having reference numerals 12, 13, 14, 15 and 18 which are identical to those previously shown in FIG. 3. The feeder can rotate about a pivot pin 302 each end of which is fitted into a corresponding hole in each of the internal sides of the base 350.

There is a cutter 305 which is movably supported relative to the base, and which is also movable relative to the feeder. There is a cutter arm 306 which supports the cutter blade 357. The cutter arm can rotate about a cutter pivot pin 307 which is fitted into a corresponding hole in each of the internal sides of the base 350.

There is a link 303 which is connected to the feeder support 301 and to the cutter arm 306 by a link pin 304 at each end. Therefore, the link is pivotably connected at one end to the feeder 300, and is pivotably connected at the other end to the cutter 305. The link acts as a means of powering the cutter, where if the feeder moves, then the means of powering causes the cutter to move, and if the feeder stops, then the cutter stops, and if the feeder is at the initial position, then the cutter is at the start position, and if the feeder is at the cutting position, then the cutter is at the severing position.

Another feature of the cutter is the spring mount 308. A feature of the base is a spring anchor 309. A spring 310 is connected at one end to the spring mount and at the other to the spring anchor.

Together, the feeder support 301, the link 303, the cutter arm 306 and the base 350 make up a linkage. The force applied by the spring 310 is transmitted with certain force vector components (well understood by those in the field) to create a certain force acting at the tape location at the upper end of the feeder support. The weights of the feeder support, link and cutter arm likewise create a certain force acting at the tape location. The sum of all forces acting at the tape location will be referred to as a bias force and will act to urge the feeder support to rotate in a counterclockwise direction. The bias force changes as a function of the angular position of the feeder support. The spring is sized to provide a bias force that is less than the drag force for all angular positions of the feeder support.

The initial (at rest) position of the third embodiment of the present invention is shown in FIG. 15 where the feeder 300 is at an initial position (most counterclockwise in this view) Because of the link 303, the cutter is simultaneously at a start position (most counterclockwise.) All parts are stopped by the cutter arm 306 impinging on a stop edge 311, and the cutter is being urged counterclockwise by the bias force. This embodiment of the present invention is preferred, because the linkage guides the feeder high and retracts the cutter 305 into the base 350, thus providing a most accessible extended tape end 355 (of the three shown downward-cutting embodiments of the present invention.) To begin the dispensing cycle, the user will grasp the extended tape end and move in an initial pull direction shown by an arrow noted by reference numeral 360. Notice that there is a slack shape 353 in the tape between the roll of tape 351 and the feeder. This is a consequence of the final act of the dispensing cycle, which will be described later.

The drag force of the feeder 300 is designed to be greater than the bias force provided by the spring 310. Therefore, as the extended tape end 355 is pulled, the feeder moves clockwise, the link 303 powers the cutter 305 clockwise, until a foot 312 stops against a stop ledge 313. This stop ledge is a means of preventing movement of the feeder beyond a cutting position in a direction away from the initial position. At this point, FIG. 16 shows the feeder at a cutting position and shows the cutter at a severing position. The user moves in the continued pull direction shown by an arrow noted by reference numeral 361. The drawn piece of tape 352 is pulled into a straight shape 354 and then additional tape is peeled from the roll of tape 351 and is yielded through the feeder until a length of tape as desired by the user is extended. Finally, the user manually forces the tape in a cutting direction as shown by an arrow noted by reference numeral 362, until the tape is severed against the sharp edge 364 (FIG. 15) of the cutter blade 357.

FIG. 16 shows the position where all of the components are located at that moment in time when a segment of tape 356 is cut. This segment was previously the extended tape end 355 (FIG. 15) plus additional length yielded by the user. After the cut, there is a new extended tape end 355' (FIG. 16.)

Just before the position shown in FIG. 16, the continued pulling and tension in the tape kept the feeder 300 stopped clockwise. But, after the cut is made, the feeder is free to return to the initial position, and the cutter 305 is free to return to the start position. Both rotate back counterclockwise by the bias force of the spring 310. Then, the present invention again looks as shown in FIG. 15. Notice that a surplus of the drawn piece of tape 352 forms a slack shape 353 again, and that a cut edge 363 has moved away from the sharp edge 364.

Figure 17:
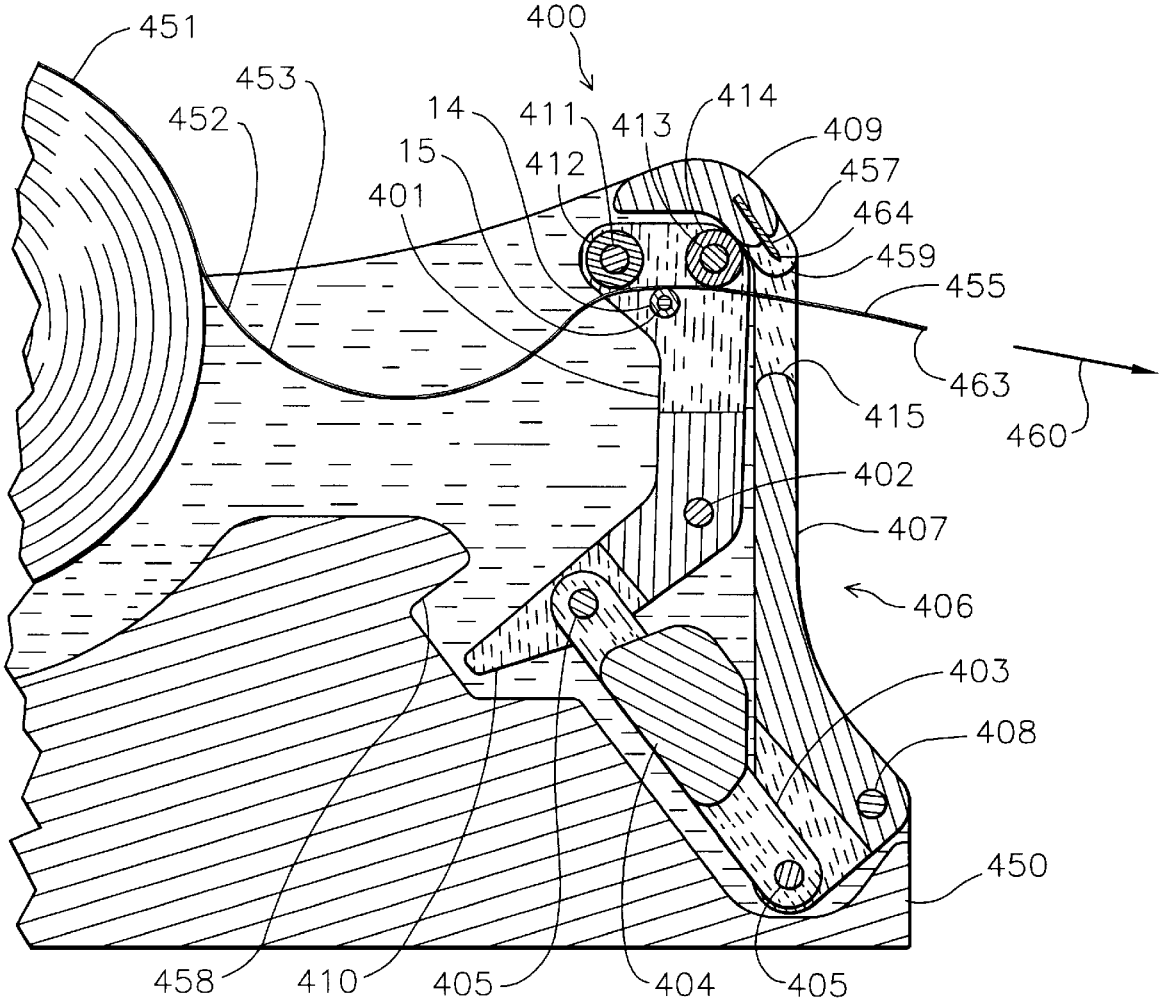
FIG. 17 is a side cross-sectional view of the fourth embodiment of the present invention in the initial position, ready to dispense a new segment of tape.
Figure 18:
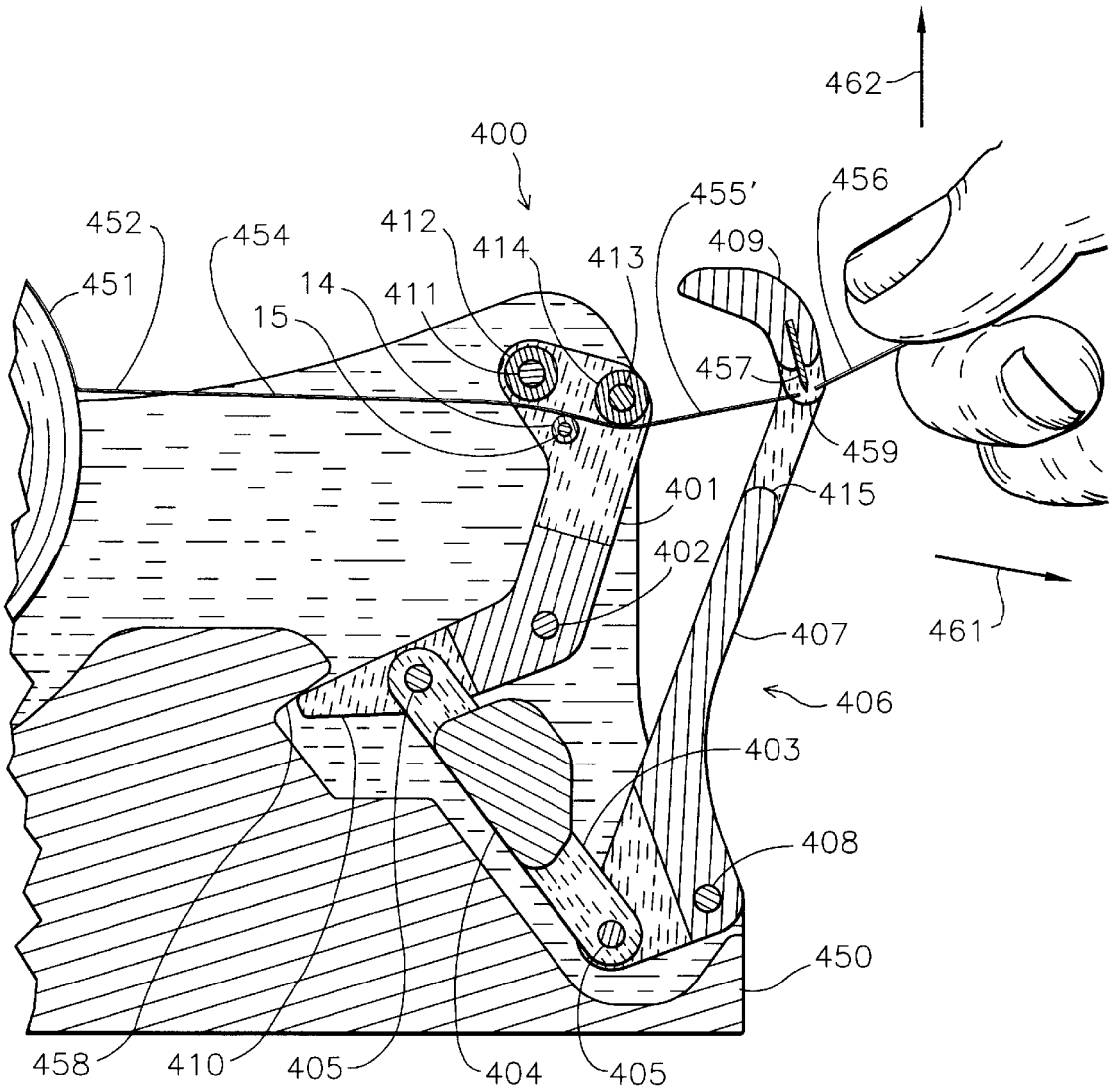
FIG. 18 is a side cross-sectional view of the fourth embodiment of the present invention at the moment when a new segment of tape is cut.

The fourth embodiment of the present invention is shown in FIGS. 17 and 18. A tape dispenser base 450 is shown in cross-section and may be considered to have a full construction symmetrical about the cutting plane. Conventional elements include a roll of tape 451, a drawn piece of tape 452, a cutter blade 457 having a sharp edge 464, which is held in place by a friction fit into a corresponding slot in an upper cover 409. There is a side guard 459 adjacent to the blade on each end to protect the user from being accidentally cut. This embodiment of the present invention works best with a tape having one sticky side, which is installed on the lower side.

There is a feeder 400 which is movably supported relative to the base. There is a feeder support 401 which supports components having reference numerals 14 and 15 which are identical to those previously shown in FIG. 3. There is a left roller 412 which turns on a left shaft 411. There is a right roller 414 which turns on a right shaft 413. The feeder can rotate about a pivot pin 402 which is fitted into a corresponding hole in each of the internal sides of the base 450. The upper rollers (each or both) could be replaced with a fixed rod, similar to keeper 18 shown in FIG. 3 if more drag force is required.

There is a link 403 which is connected to the feeder support 401 and to a cutter arm 407 by a link pin 405 at each end. Therefore, the link is pivotably connected at one end to the feeder 400, and pivotably connected at the other end to a cutter 406. The link acts as a means of powering the cutter, where if the feeder moves, then the means of powering causes the cutter to move, and if the feeder stops, then the cutter stops, and if the feeder is at the initial position, then the cutter is at the start position, and if the feeder is at the cutting position, then the cutter is at the severing position. There is a weight 404 which is shown in the middle of the link.

There is the cutter 406 which is movably supported relative to the base, and which is also movable relative to the feeder 400. There is the cutter arm 407 which supports the upper cover 409 in which the cutter blade 457 is held in place. There is an aperture in the cutter arm, whose aperture edge is noted by reference numeral 415. An extended tape end 455 passes through the aperture. The cutter arm can rotate about a cutter pivot pin 408 which is fitted into a corresponding hole in each of the internal sides of the base 450.

Together, the feeder support 401, the link 403, the cutter arm 407 and the base 450 make up a linkage. The force applied by the weight 404 is transmitted with certain force vector components (well understood by those in the field) to create a certain force acting at the tape location at the upper end of the feeder support. The weights of the feeder support, and cutter arm likewise create a certain force acting at the tape location. The sum of all forces acting at the tape location will be called the bias force and will act to urge the feeder support to rotate in a counterclockwise direction. The bias force changes as a function of the angular position of the feeder support. The weight is sized to provide a bias force that is less than the drag force for all angular positions of the feeder support.

The initial (at rest) position of the fourth embodiment of the present invention is shown in FIG. 17 where the feeder 400 is at an initial position (most counterclockwise in this view) where the linkage is stopped by the cutter arm 407 impinging on the feeder support 401, and where the feeder is being urged counterclockwise by the bias force. The fourth embodiment of the present invention has a simple appearance, because the upper cover 409 conceals the feeder 400 and the cutter 406 retracts into the base 450. The extended tape end 455 is seen projecting through the aperture. To begin the dispensing cycle, the user will grasp the extended tape end 455 and move in an initial pull direction shown by an arrow noted by reference numeral 460 in FIG. 17. Notice that there is a slack shape 453 in the tape between the roll of tape 451 and the feeder 400. This is a consequence of the final act of the dispensing cycle, which will be described later.

The drag force of the feeder 400 is designed to be greater than the bias force provided by the weight 404. Therefore, as the extended tape end 455 is pulled, the feeder moves clockwise, the link 403 powers the cutter 406 clockwise, until a foot 410 impinges against a stop ledge 458. This stop ledge is a means of preventing movement of the feeder beyond a cutting position in a direction away from the initial position. At this point, FIG. 18 shows the feeder at a cutting position and the cutter at a severing position. The user moves in the continued pull direction shown by the arrow noted by reference numeral 461 in FIG. 18. The drawn piece of tape 452 is pulled into a straight shape 454 and then additional tape is peeled from the roll of tape 451 and is yielded through the feeder until a length of tape as desired by the user is extended. Finally, the user manually forces the tape upward in a cutting direction as shown by an arrow noted by reference numeral 462, until the tape is severed against the sharp edge 464 (FIG. 17) of the cutter blade 457. The user will need to become accustomed to the lift-to-cut action, which is opposite from that used in conventional tape dispensers.

FIG. 18 shows the position where all of the components are located at that moment in time when a segment of tape 456 is cut. This segment was previously the extended tape end 455 (FIG. 17) plus additional length yielded by the user. After the cut, there is a new extended tape end 455' (FIG. 18.)

Just before the position shown in FIG. 18, the continued pulling and tension in the tape kept the feeder 400 stopped clockwise. But, after the cut is made, the feeder is free to return to the initial position, and the cutter 406 is free to return to the start position. Both are rotated back counterclockwise by the bias force of the weight 404. Then, the present invention again looks as shown in FIG. 17. Notice that a surplus of the drawn piece of tape 452 forms a slack shape 453 again, and that a cut edge 463 has moved away from the sharp edge 464.

The feeders shown in the tape dispensing embodiments of the present invention can return to their initial position after the cut is made, because the bias force also acts to "unstick" the cut edge of the new extended material end from the sharp edge. Therefore, the bias force should be greater than the force needed to unstick the cut edge of tape. Notice that the first and second embodiments of the present invention each a have feeder which moves away from the cutter after the cut is made. The third embodiment of the present invention acts differently to unstick the cut edge of the tape. The third embodiment has a linkage which was designed (for purposes of illustration) so that the distance between the small roller 14 and the sharp edge 364 in FIG. 15 is the same distance in FIG. 16. Therefore, the third embodiment of the present invention acts to unstick the cut edge of the tape by rotating it laterally upward. This causes the cut edge to unstick, without the feeder 300 necessarily moving away from the cutter blade. Furthermore, in the fourth embodiment of the present invention, it can be seen that the feeder 400 actually moves closer to the cutter blade 457 after the cut, yet the tape reliably springs away to create an extended tape end 455. However, note that in all shown embodiments of the present invention, the cut edge moves away from the sharp edge after cutting.

Many inventions of prior art include a brake to halt the material while being cut. However, a unique feature of the present invention is that the material may still be extended during the cut. Yet, it is desirable to hold the material steady for achieving a clean cut. This is accomplished in the present invention by making the drag force significant, while not so large as to discourage the user.

Each of the cutters or cutter blades shown by reference numerals 157, 257, and 357, is shown attached by a screw (158, 258, and 358). However, it could also be fitted into a slot such as is shown by cutter blade 457 in FIG. 17, or it could be made an integral feature (and not a separate part.) The cutter is shown having a sharp edge 164, 264, 364, and 464, which can be serrated, vee-notched, or uninterrupted, and can be straight, nonstraight, horizontal, or non-horizontal.

Since it would be more convenient to use the present invention with one hand, it is desirable that the base be weighted sufficiently to prevent it from moving across a table during the feed operation.

Since the drag force is provided by friction, it is now instructive to discuss the nature of a slipping friction action. A static friction force may be greater than a dynamic friction force. With respect to the present invention, when making comparisons to the value of the bias force, and when pulling to yield additional material, the value of the drag force is determined by the dynamic friction characteristics. However, when describing the action at the instant when the material or roller slips, the drag force is determined by the static friction characteristics.

Although the bias force has been discussed, the device which provides this force is more properly defined as a "stored energy" means. The energy of the stored energy means increases when the feeder is moved away from the initial position. This is because some of the energy of pulling the material is stored. When released by the severing, the stored energy means provides a "force acting over a distance" (the definition of energy) to return the feeder. Springs and weights are convenient stored energy means, but there are others which could be used in the present invention. Therefore, the stored energy means provides a bias force urging the feeder to move toward the initial position, where the bias force is less than the drag force at every feeder position.

Referring to the third and fourth embodiments of the present invention, the cutter 305, 406 may advance at a faster rate than the extended tape end 355, 455, itself Therefore, it might interfere with the hand of the user during early stages of tape extending. If this happens, the linkage will automatically balance the forces, allowing a short length of the tape to advance through the feeder 300, 400. In practice, this happens without the user taking much notice. These embodiments each show a cutter which rotates, however a cutter which only translates could be incorporated into the present invention.

A dispenser feeder which "yieldably retains" a material of indeterminate length has been defined, and several methods of constructing such feeder have been demonstrated. Four embodiments of the present invention have been described in detail. General considerations about how best to configure and operate the present invention have been disclosed. The special case of using the present invention to dispense adhesive tape has been described by way of example rather than by limitation. It is clear that the present invention is equally applicable for the improved dispensing of ribbon, film, sheet foil, wrapping paper and the like, as well as string, wire, hose, and the like. Therefore, the invention presently disclosed which dispenses these and other materials of indeterminate length is deemed to be within the spirit and scope of the following claims.

What is claimed is:

1. A device which is manually powered for dispensing material of indeterminate length, which device comprises:

a. a feeder, which is movably supported between an initial position and a cutting position, the feeder comprising a means of yieldably retaining from which an extended material end may be disposed in a cantilever manner, wherein if a first pulling force which is less than a drag force were to be exerted upon the extended material end, then the material would not move relative to the feeder, and wherein if a second pulling force which is equal to or greater than the drag force were to be exerted upon the extended material end, then the material would move relative to the feeder;

b. a stop for preventing movement of the feeder beyond the cutting position in a direction away from the initial position;

c. a stored energy means, wherein energy of the stored energy means increases when the feeder is moved away from the initial position, the stored energy means providing a bias force urging the feeder to move toward the initial position, wherein the bias force is less than the drag force at every feeder position;

d. a cutter, having a sharp edge;

whereby it necessarily follows, if the first pulling force were to be exerted upon the extended material end, then the feeder would move away from the initial position; and whereby thereafter if the feeder is stopped at the cutting position and the second pulling force where to be exerted on the extended material end, then the feeder would yield an additional length of material; and whereby thereafter if the additional length of material were to be manually forced against the sharp edge, then it would sever; and whereby thereafter if the additional length of material were to be severed, then the stored energy means would cause the feeder to return to the initial position;

wherein thereafter, a distance between a cut edge of a new extended material end and the sharp edge would increase.

2. The device of claim 1, wherein said cutter is fixed.

3. The device of claim 2, wherein said means of yieldably retaining comprises at least two non-rotating surfaces located in opposition around the material, wherein at least one of the surfaces is for frictional contact with the material.

4. The device of claim 2, wherein said means of yieldably retaining comprises at least two surfaces located in opposition around the material, wherein at least one of the surfaces comprises a roller having frictional contact with the material, wherein the roller is rotatably supported by the feeder.

5. The device of claim 2, wherein said stored energy means comprises a spring.

6. The device of claim 2, wherein said stored energy means comprises an unbalanced weight.

7. The device of claim 2, which comprises a means of support for a supply of material.

8. The device of claim 1, wherein the cutter is movably supported, between a start position and a severing position, which device comprises:

a means of powering the cutter, wherein if the feeder moves, then the means of powering causes the cutter to move, and wherein if the feeder stops, then the means of powering causes the cutter to stop, and wherein if the feeder is at the initial position, then the cutter is at the start position, and wherein if the feeder is at the cutting position, then the cutter is at the severing position.

9. The device of claim 8, wherein said means of powering comprises a link, which is pivotably connected at a first end to the feeder, and which is pivotably connected at a second end to the cutter.

10. The device of claim 8, wherein said means of yieldably retaining comprises at least two non-rotating surfaces located in opposition around the material, wherein at least one of the surfaces is for frictional contact with the material.

11. The device of claim 8, wherein said means of yieldably retaining comprises at least two surfaces located in opposition around the material, wherein at least one of the surfaces comprises a roller having frictional contact with the material, wherein the roller is rotatably supported by the feeder.

12. The device of claim 8, wherein said stored energy means comprises a spring.

13. The device of claim 8, wherein said stored energy means comprises an unbalanced weight.

14. The device of claim 8, which comprises a means of support for a supply of material.

15. A manually powered tape dispenser for dispensing segments of tape of the type which has adhesive on at least one side, which dispenser comprises:

a. a feeder, which is movably supported between an initial position and a cutting position, the feeder comprising a means of yieldably retaining from which an extended tape end may be disposed in a cantilever manner, wherein if a first pulling force which is less than a drag force were to be exerted upon the extended tape end, then the tape would not move relative to the feeder, and wherein if a second pulling force which is equal to or greater than the drag force were to be exerted upon the extended tape end, then the tape would move relative to the feeder;

b. a stop for preventing movement of the feeder beyond the cutting position in a direction away from the initial position;

c. a stored energy means, wherein energy of the stored energy means increases when the feeder is moved away from the initial position, the stored energy means providing a bias force urging the feeder to move toward the initial position, wherein the bias force is less than the drag force at every feeder position;

d. a cutter, having a sharp edge;

whereby it necessarily follows, if the first pulling force were to be exerted upon the extended tape end, then the feeder would move away from the initial position; and whereby thereafter if the feeder is stopped at the cutting position and the second pulling force where to be exerted on the extended tape end, then the feeder would yield an additional length of tape; and whereby thereafter if the additional length of tape were to be manually forced against the sharp edge, then it would sever; and whereby thereafter if the additional length of tape were to be severed, then the stored energy means would cause the feeder to return to the initial position;

wherein thereafter, a distance between a cut edge of a new extended tape end and the sharp edge would increase.

16. The tape dispenser of claim 15, wherein said cutter is fixed.

17. The tape dispenser of claim 16, wherein said means of yieldably retaining comprises at least two non-rotating surfaces located in opposition around the tape, wherein at least one of the surfaces is for frictional contact with the tape.

18. The tape dispenser of claim 16, wherein said means of yieldably retaining comprises a roller for adhering contact with the tape, wherein the roller is rotatably supported by the feeder.

19. The tape dispenser of claim 18, wherein said roller comprises a cambered surface for supporting the extended tape end in a straight shape.

20. The tape dispenser of claim 16, wherein said stored energy means comprises a spring.

21. The tape dispenser of claim 16, wherein said stored energy means comprises an unbalanced weight.

22. The tape dispenser of claim 16, which comprises a means of support for a roll of tape.

23. The tape dispenser of claim 15, wherein the cutter is movably supported, between a start position and a severing position, which dispenser comprises:

a means of powering the cutter, wherein if the feeder moves, then the means of powering causes the cutter to move, and wherein if the feeder stops, then the means of powering causes the cutter to stop, and wherein if the feeder is at the initial position, then the cutter is at the start position, and wherein if the feeder is at the cutting position, then the cutter is at the severing position.

24. The tape dispenser of claim 23, wherein said means of powering comprises a link, which is pivotably connected at a first end to the feeder, and which is pivotably connected at a second end to the cutter.

25. The tape dispenser of claim 23, wherein said means of yieldably retaining comprises at least two non-rotating surfaces located in opposition around the tape, wherein at least one of the surfaces is for frictional contact with the tape.

26. The tape dispenser of claim 23, wherein said means of yieldably retaining comprises a roller for adhering contact with the tape, wherein the roller is rotatably supported by the feeder.

27. The tape dispenser of claim 26, wherein said roller comprises a cambered surface for supporting the extended tape end in a straight shape.

28. The tape dispenser of claim 23, wherein said stored energy means comprises a spring.

29. The tape dispenser of claim 23, wherein said stored energy means comprises an unbalanced weight.

30. The tape dispenser of claim 23, which comprises a means of support for a roll of tape.

* * * * *